US006065232A

United States Patent [19]

Haughey et al.

[11] Patent Number: 6,065,232

[45] Date of Patent: May 23, 2000

[54] MULTIPLE DISPLAY SYSTEM

[75] Inventors: Charles S. Haughey, Northridge; Peter D. Young, Chatsworth, both of Calif.; Stephen A. Gelnett, Virginia Beach, Va.

[73] Assignee: Pulse Indstries Corporation, Arcadia, Calif.

[21] Appl. No.: 09/183,828

[22] Filed: Oct. 30, 1998

Related U.S. Application Data

[60] Provisional application No. 60/063,773, Oct. 31, 1997.

[51] Int. Cl.[7] ..... G09F 11/02

[52] U.S. Cl. ..... 40/503; 40/493

[58] Field of Search ..... 40/503, 501, 502, 40/504, 505, 506, 446, 493

[56] References Cited

U.S. PATENT DOCUMENTS

| | | | |
|---|---|---|---|
| 4,002,022 | 1/1977 | Lopez | 40/505 X |
| 4,274,218 | 6/1981 | Harvey . | |
| 4,381,616 | 5/1983 | Saxer | 40/503 X |
| 4,528,763 | 7/1985 | Ahlgren | 40/503 X |
| 4,638,580 | 1/1987 | Giannetti et al. | 40/503 |
| 4,753,025 | 6/1988 | Wennström . | |
| 4,987,691 | 1/1991 | Kessels et al. . | |
| 5,022,172 | 6/1991 | Kawahara et al. | 40/446 X |
| 5,233,772 | 8/1993 | Bergeron et al. . | |
| 5,315,776 | 5/1994 | Strawbridge et al. . | |
| 5,416,996 | 5/1995 | Clemens et al. . | |
| 5,528,258 | 6/1996 | Moon | 40/503 X |
| 5,696,494 | 12/1997 | Chen | 40/503 X |
| 5,806,221 | 9/1998 | Vander Woude | 40/503 |

*Primary Examiner*—Terry Lee Melius
*Assistant Examiner*—William L. Miller
*Attorney, Agent, or Firm*—Law Offices of Terry McHugh

[57] ABSTRACT

An apparatus for controlling a drive mechanism of a panel display system includes a rotary member attached to a drive assembly, the rotary member having indicators located at known intervals that are detected to ensure that the drive assembly starts and stops at precise locations. In a preferred embodiment, the control system is applied to a panel display system that displays different scenes using an array of elongated three-sided display elements. The preferred control system includes an aluminum disk that is attached to rotate in connection with rotation of the drive assembly.

19 Claims, 12 Drawing Sheets

MULTIPLE DISPLAY SYSTEM

This application claims the benefit of U.S. Provisional Application No. 60/063,773, filed Oct. 31, 1997.

TECHNICAL FIELD

The present invention relates generally to display devices and more particularly to devices which have a number of information-bearing panels which are arranged in such a way that the panels produce a scene.

BACKGROUND ART

There are a wide variety of devices for presenting information in a manner designed to attract attention. One such device utilizes an array of discrete elongated three-sided sign elements arranged side-by-side to form scenes. The scenes may include messages, pictures, and advertisements etc. The device has a mechanism for rotating the three-sided sign elements in 120° increments, thereby displaying each of the three different panels of the three-sided sign elements sequentially. The rotating mechanism typically involves a system of shafts, bearings, mounts and motors arranged to achieve the desired rotation.

An adaptation of the device is one in which the array of discrete elongated three-sided sign elements are made up of three distinct panels which have scenes on both sides of the panels. That is, each element is still triangular, but each side (i.e., panel) of the triangle rotates 180°, doubling the number of different scenes. The device has a mechanism to rotate the three-sided sign elements so that each of the three outer surfaces of the sign are displayed sequentially. As well, during each 120° incremental rotation, one of the three sign elements is rotated 180° around its own axis such that the scene that is on the inner surface of the panel is moved to the outer surface of the sign element. Thus, two 360° rotations of the three-sided elements will complete the display of all six panel sides.

As described in U.S. Pat. No. 4,274,218 to Harvey, to enable the 180° rotation of one panel, the two other panels are oscillated to avoid interference with adjacent panels. The oscillation of the two panels is required so that there is adequate clearance from adjacent panels for the 180° rotation of the "flipping" panel. This action requires a complex dual cam system which must be precisely synchronized to work effectively.

As part of most of these systems, a crank arm may be used to impart rotary motion to a carrier shaft, to which are attached the sign elements. To attach the crank arm to the carrier shaft, a small hole is drilled through the side of the carrier shaft. A roll pin is then driven through a common hole in the crank arm and the carrier shaft. However, the carrier shaft is typically made of polymer plastic and is prone to cracking at the connection hole. The cracking can cause undesirable play or slop in the panel movement and can cause interference with adjacent panels.

These devices also have panel holders which are used to attach the panels to the rotation and display mechanism. To attach the panels to the panel holders, the panels are usually sandwiched between two metal clips and glued or fastened therein. The metal clips are then slid into the panel holders at the top of the display and then attached to spring-loaded clips at the bottom to provide tension to stretch the panels and maintain alignment. Gluing the panels is labor-intensive, and the panels are susceptible to separation from the metal clips due to poor panel-to-metal adhesion in the gluing process. As well, installation of the metal clips into the panel holders is labor-intensive and requires a specially trained individual to assure alignment.

In addition, these devices have drive systems which rotate the sign elements. Typically, two synchronous motors are employed to drive the cam follower mechanism. One motor is usually mounted adjacent to the top drive assembly, while the other is usually mounted adjacent to the bottom drive assembly. With this configuration, it can be difficult to synchronize the motion of the two motors so that the cams are driven at precisely the same rate and time and the panels are precisely aligned.

Further, the drive systems have no internal means to respond to or deal with either an internal mechanical malfunction or an exterior power failure. If the drive mechanism loses power between indexes, the unit will stop with the panels "in between" their display position. When the power is reapplied, the drive mechanism will advance the panels another 120° and the device will be in between display positions again.

Currently, the cam assemblies that create the unique rotary and angular movement of the panels are made with a polymer utilizing injection molding. Each individual molded polymer cam is precisely mounted in an extruded aluminum "inter-frame." Two opposed cam assemblies are required for each array of prisms. The production of the cam and inner frame is time consuming and costly. Additionally, over time, the molded polymer cam sometimes becomes brittle and discolored, which makes the cam unattractive and subject to failure.

What is needed is a simple and effective mechanism that allows the panels of a three-sided sign element to be rotated such that all six sides of the panels can be viewed; a method for attaching a carrier shaft to a drive gear which holds the crank arm securely without cracking the carrier shaft; a way to attach panels to panel holders which is easy and durable; a synchronized drive mechanism; a way to ensure that the drive mechanism is always able to know where to stop such that the sign elements are properly displayed; and a cam assembly that is easier to build and will not break down over time.

SUMMARY OF THE INVENTION

An apparatus for controlling a drive mechanism of a panel display system includes a rotary member attached to a drive assembly, the rotary member having indicators located at known intervals that are detected to ensure that the drive assembly starts and stops at precise locations. In a preferred embodiment, the control system is applied to a panel display system that displays different scenes using an array of elongated three-sided display elements. The preferred control system includes an aluminum disk that is attached to rotate in connection with rotation of the drive assembly. The aluminum disk has three machined slots, one at every 120°. The control system also includes a photo detector which is mounted adjacent to the disk such that a beam of light directed toward the photo detector either passes through one of the slots of the disk or is blocked from the photo detector by the solid portion of the disk.

In operation, as the disk rotates in concert with the drive assembly, the photo detector detects the slots at every 120° of rotation and signals to the drive mechanism. The drive mechanism can then stop at a location that properly displays the scenes on the display panels. The rotation of the disk is preferably directly related to the rotation of the three-sided display elements. By utilizing a control system such as an optical sensor system that is directly tied to the rotation of the display elements, the display elements can be brought into proper position more accurately after unexpected interruptions such as jams or power interruptions.

An additional aspect of the invention involves a carrier shaft and drive gear assembly. The assembly consists of a carrier shaft, a drive gear, a screw and a washer. The drive gear is fit over the carrier shaft and the screw is driven into the end of the carrier shaft, thereby securing the drive gear. Additionally, the matching horizontal surfaces of the drive gear and the carrier shaft may be radially grooved or geared, or the shaft and matching sleeve of the drive gear may be non-circular to provide an indexed drive.

A second additional aspect of the invention involves a panel holder assembly which attaches display panels to panel holders and carriers. In this invention, holes are created at both ends of the display panels. The panel holders have panel holding fingers which are attached to a base plate. The base plate has attachment clips which connect to a base plate receiver, all of which combine to make up the complete panel holder. The display panels are attached to the panel holding fingers by sliding the fingers into the holes at the end of the panels. The panels are attached to the panel holders first at one end of the panels, typically the top, and then at the other end, typically the bottom. The bottom panel holder is spring loaded for tension which provides proper alignment of the panels.

A third additional aspect is a reduction of the complexity of a panel display rotation mechanism. This system for displaying six posters utilizes one panel holder on each end of three panels. The panel holders and panels are arranged in a triangle, thereby forming an elongated three-sided prism having three faces to present scenes. Each panel has two sides, with each opposite face having a different scene. The three panel holders rotate 120° to present three faces sequentially, while simultaneously one of the three panels that is not in view rotates an additional 180° so that the opposite face of the panel can be seen when that panel reaches the display position. This continues such that all six faces of the three panels are displayed.

Rotating the three panels and flipping one of the panels are accomplished by utilizing simple matching cams at each end of each elongated three-sided prism, spring-loaded slides at each end of each prism, and cam followers traveling on the cam faces provided at each end of each prism. As the panels turn, one panel is moved outward from the center of the triangular panel holder configuration to the turning position opposite the line of display. The leading edge of the panel holder falls into a cam recess or node towards the center of the panel holder axis of rotation. The recess is located sufficiently far from the center of the cam to allow the panel to rotate without interfering with the other adjacent panels. The recess causes the cam follower to tumble over, reversing the leading and following ends, and turning the panel holder 180°. As the cam follower continues to move to the display position, the panels are held perpendicular to the radius of the circle of rotation, and thus are aligned to form a flat poster in the second display position, showing the face of a panel that was unseen during the first full rotation.

Another aspect of the invention involves utilizing a single, slightly larger, motor and a vertical drive shaft in the drive assembly. In this drive assembly, a single motor drives one end of the display elements via means such as a drive belt. A drive shaft is then utilized to provide the same rotary motion to the other end of the display elements. As a result, both drive mechanisms of the display element are mechanically synchronized and work in unison.

Another aspect of the invention involves the cam assembly. The cam typically consists of a solid piece of aluminum plate. The base plate has a series of identical cam slots or channels machined into the metal base plate. Each cam slot receives a spring loaded slide and at the outer end holds the panel holder assembly and the cam rollers. This enables the holder assembly to move outward from the center of rotation of the carrier like a telescoping file drawer to enable the panels to rotate 180° without interference with adjacent panels. The cam assembly also has through holes which are located near the center point of each of the circular cam slots.

DETAILED DESCRIPTION

Carrier Shaft/Drive Gear Connection

Figure 1:
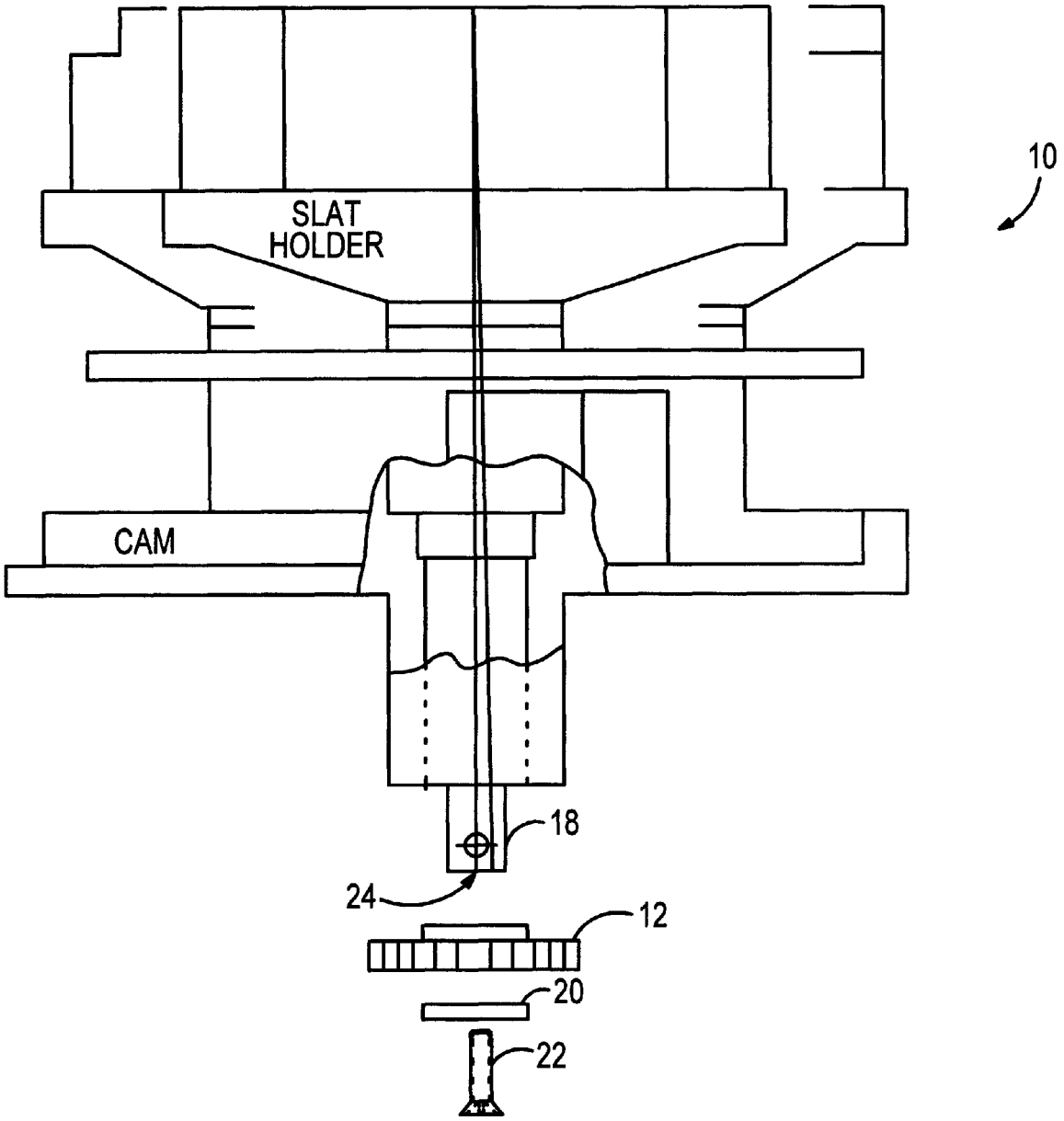
FIG. 1 is a depiction of a carrier shaft and drive gear connection assembly.

FIG. 1 depicts the preferred embodiment of the carrier shaft and drive gear connection assembly 10. This assembly consists of a carrier shaft 18, a drive gear 12, a screw 22 and a washer 20. This assembly is attached to panels that make up a panel display system. To connect the carrier shaft 18 to the drive gear 14, the appropriate opening in the drive gear 16 is placed around the carrier shaft 18. A screw 22 is inserted through a flat washer 20 and is then driven into an opening 24 that has previously been created in the carrier shaft. The screw acts to expand the carrier shaft such that a secure connection is made between the carrier shaft and the drive gear.

In other embodiments the screw may be replaced with some other device which acts to expand the carrier shaft. As well, the washer may not be necessary. Additionally, the matching horizontal surfaces of the drive gear 14 and the carrier shaft could be radially grooved or geared, or the shaft and matching sleeve of the drive gear could be non-circular to provide an indexed drive. Lastly, a crank arm may be used in place of the drive gear.

Panel Holder Assembly

Figure 2A:
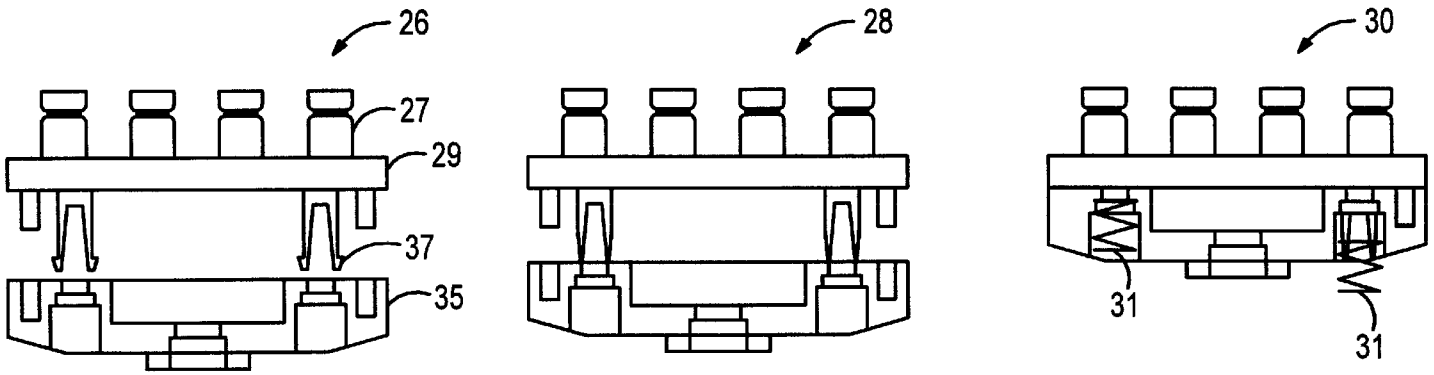
FIG. 2A is a depiction of a two-piece panel holder assembly.
Figure 2B:
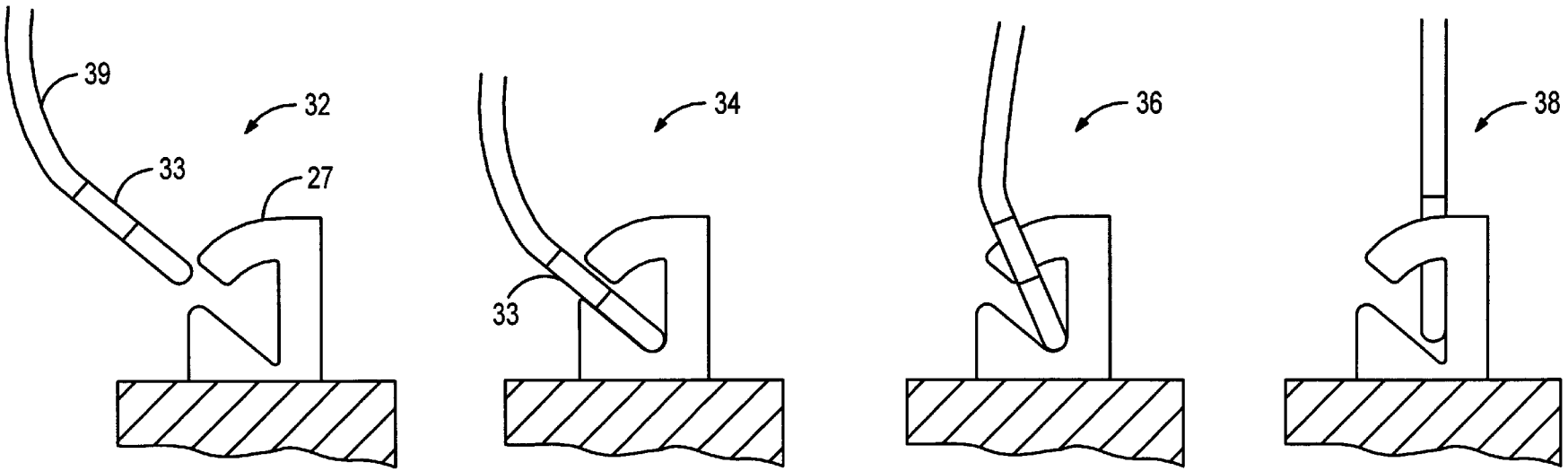
FIG. 2B is a depiction of an apparatus for attaching panels to panel holders.

A single panel holder assembly of the preferred embodiment is depicted in FIG. 2A and includes panel holding fingers 27, a base plate 29, and a base plate receiver 35. Typically, a panel holder assembly is used on each end of three panels which are held together to form an elongated three-sided prism. As shown in FIG. 2B, the panel holding fingers 27 are hook-shaped devices. Typically, four panel holding fingers are attached to each base plate 29. The base plate has attachment clips 37 which connect 28 to the base plate receiver as shown at stages 26, 28, and 30. All of the pieces combine to make up the complete panel holder.

Referring to FIG. 2B, to connect the display panels 39 to the panel holder, holes 33 are created at both ends of the display panels 39. The panels are mounted on the panel holding fingers by sliding the holes of the panels over the fingers as shown in stages 32, 34, 36, and 38. The panels are first attached at one end, typically the top, and then at the other end, typically the bottom. The bottom panel holder is typically spring loaded 31 for tension which provides proper alignment of the panels.

In other embodiments of this invention, the number of attachment fingers may vary and the panel holder assembly does not necessarily have to be made of two pieces which are attached by attachment clips.

Display Mechanism

The preferred system for displaying six posters utilizes a system of elongated three-sided display elements, carriers, cams, spring-loaded blocks, and cam followers.

Figure 3:
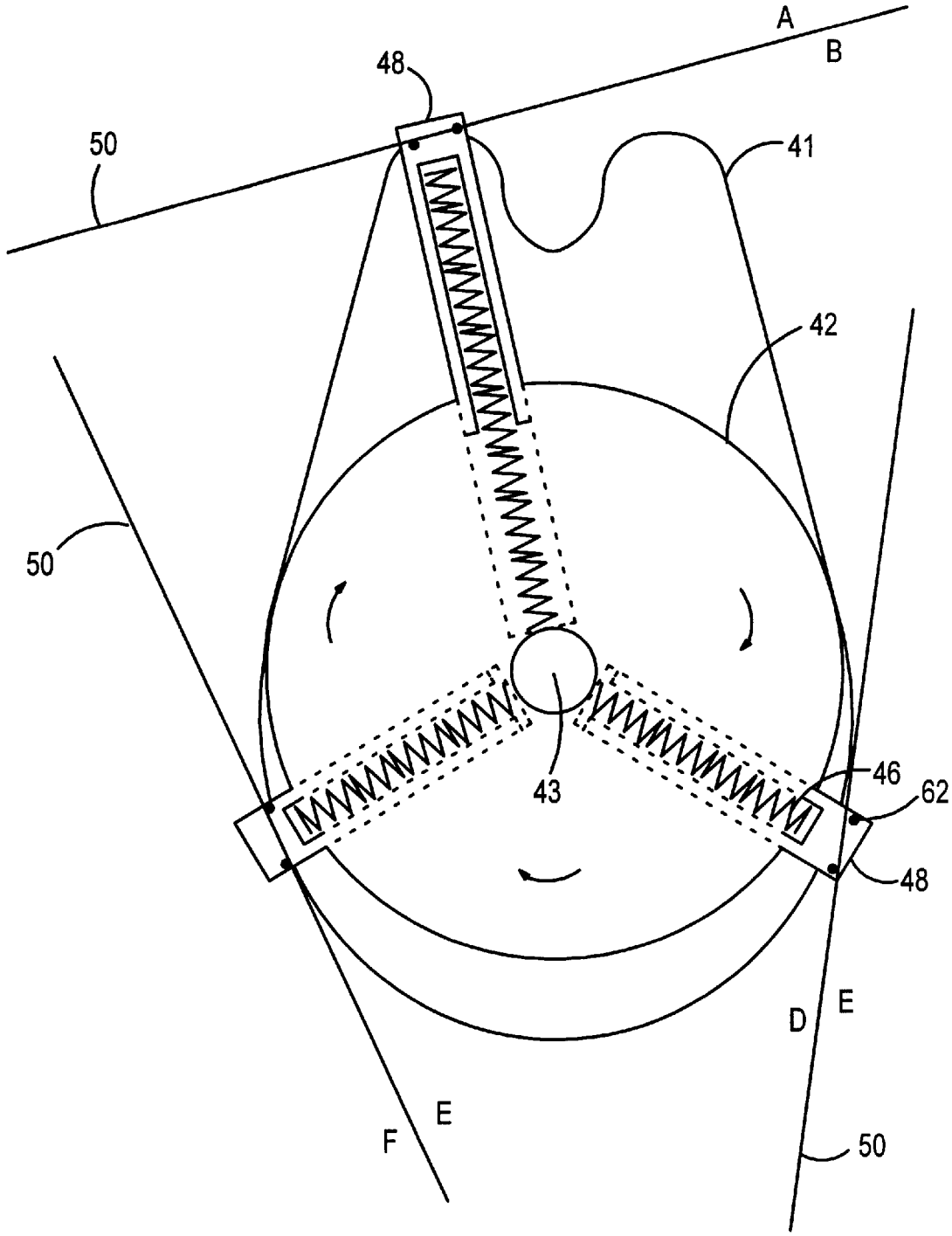
FIG. 3 is a plan view of three slide blocks rotating in a cam track, with two slide blocks retracted and one slide block extended.

FIG. 3 depicts the plan view configuration of some of the elements of the preferred embodiment. The three two-sided panels are depicted as elements 50A–F. Each panel is attached to a cam follower 62 and a slide block 48 and spring 46 on each end. The panels are positioned above and below a circular carrier 42 that has three slide blocks 48 located at 120° increments. The cam followers pass through the slide blocks and rest against the cam face 41. The cam face has an eccentric shape in which the first half of the track is substantially elliptical and the second half of the track deviates from the first half with a more elongated radius and a turning recess or node which is located at the midpoint of the second half of the circle.

Figure 8:
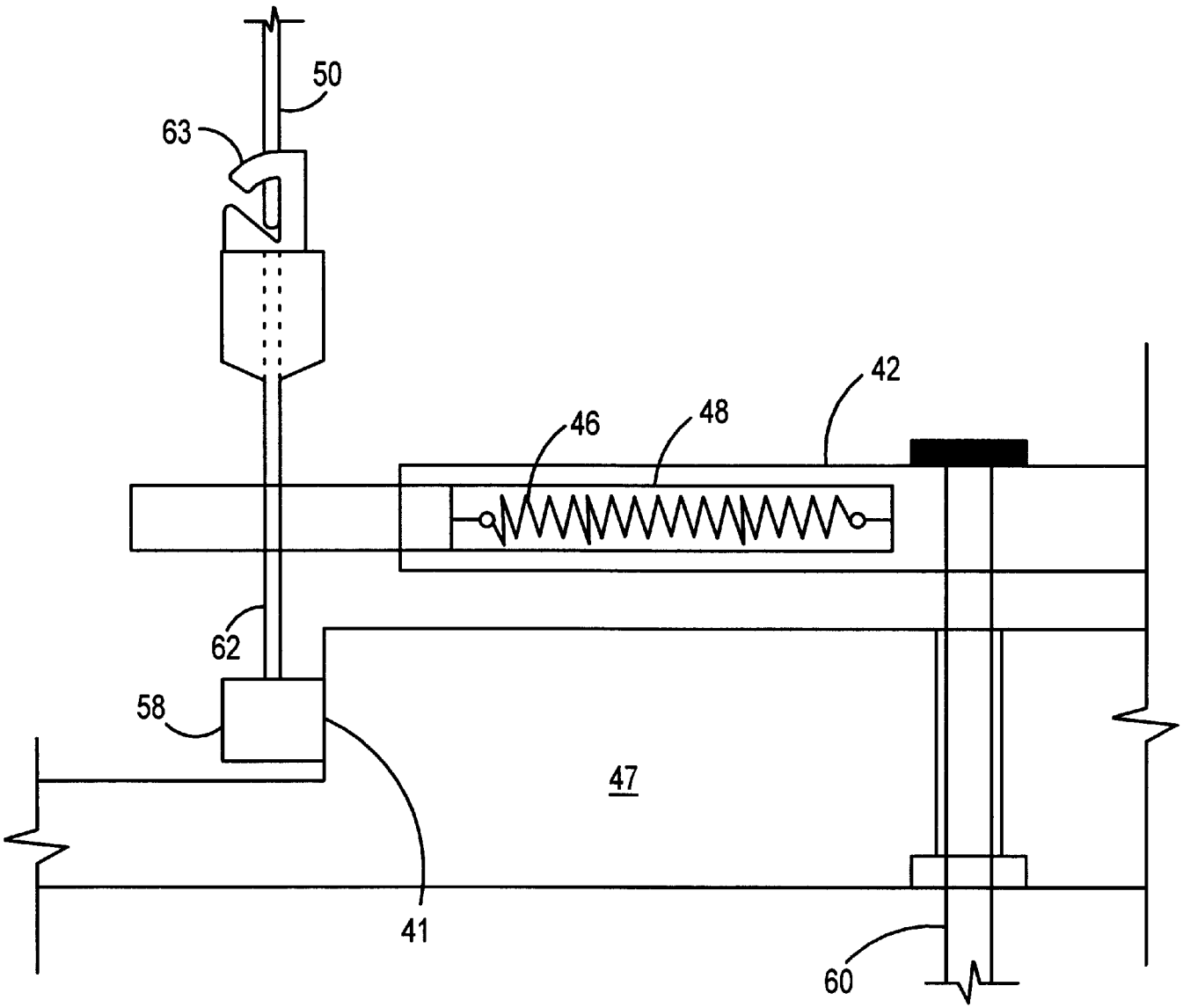
FIG. 8 is a sectional view depiction of the interface between panel holders, a carrier and a cam assembly.
Figure 9:
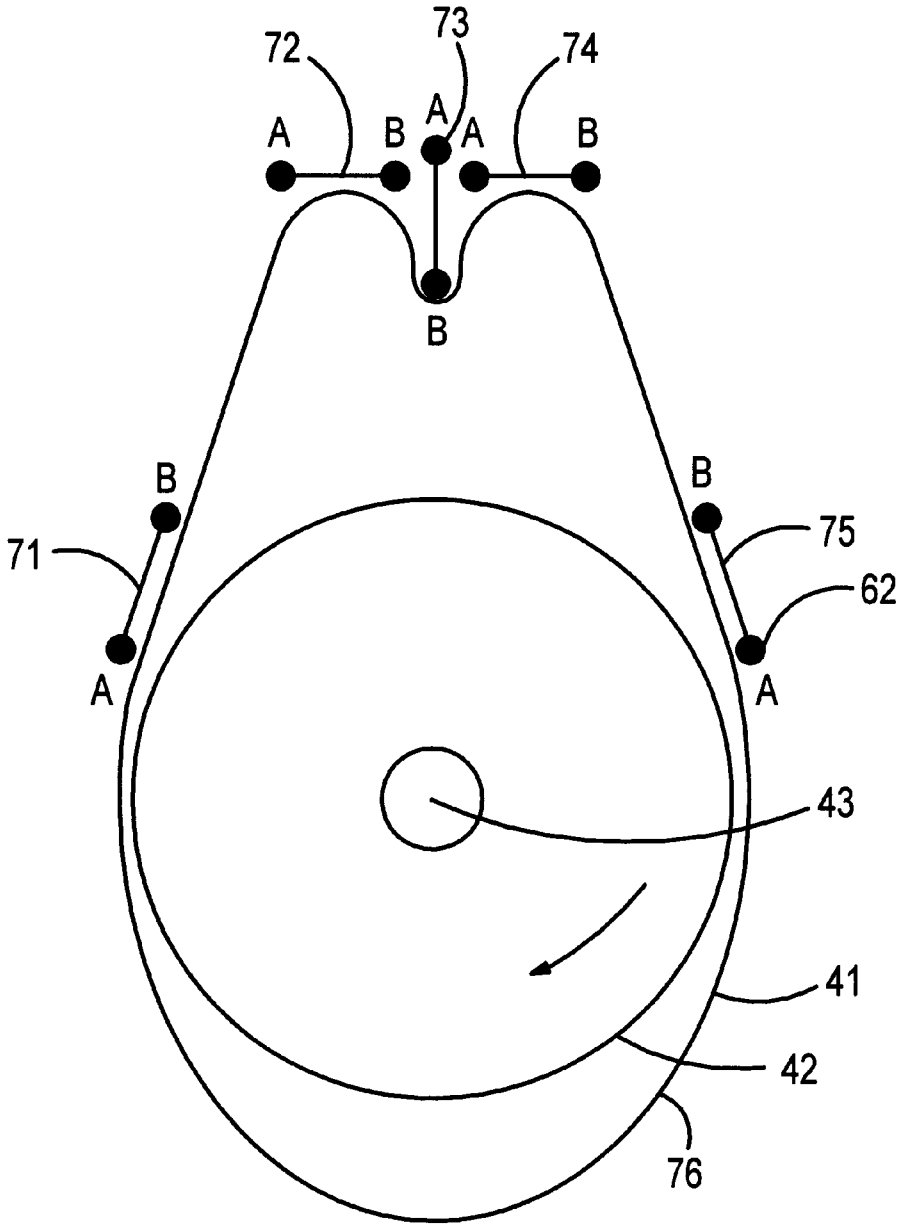
FIG. 9 is a plan view depiction of the rotation of a cam follower in a cam slot through five positions.

FIG. 8 is a sectional view of one panel attachment. The panel 50 is attached to the panel holder 63. The panel holder 63 is attached to the cam follower 62. The spring-loaded slide block 48 is attached to the panel holder/cam follower assembly. The cam follower 62 extends through the slide block 48 of the carrier and rests against the cam face 41. The cam follower has cam rollers 58 at its end. Referring to FIG. 9, the cam follower is "T" shaped with the horizontal portion of the "T" being above the cam. Below each end of the horizontal portion of the "T" are the cam rollers.

FIGS. 4 through 9 depict the operation of the preferred system. FIGS. 4 through 7 depict a plan view of two typical adjacent elongated three-sided display elements. Any number of such elements can be employed in a system. The views show the rotational movement of the carriers and the angular movement of the display panels. The four stages that are shown are intended to show the relative rotation of the different panels. The actual motion is a series of continuous 120° rotations.

As depicted in FIGS. 3 and 8, the display panels 50 are rotated by a circular carrier 42, which is mounted for rotation about a central axis 43. The carriers are rotated clockwise about their axis in steps of 120°. A timer in a P.C. board controls the movement of a synchronous motor which imparts rotary motion to the carrier drive shafts 60 of the carriers by a sprocket and chain arrangement. The drive arrangement is typically either duplicated at the top of the billboard or by extending the drive shafts upward through the center of the prism, depending on the clearances available. If drive shafts are extended vertically through the prisms, the upper drive belt and gears on each drive mechanism may be avoided.

Figure 4:
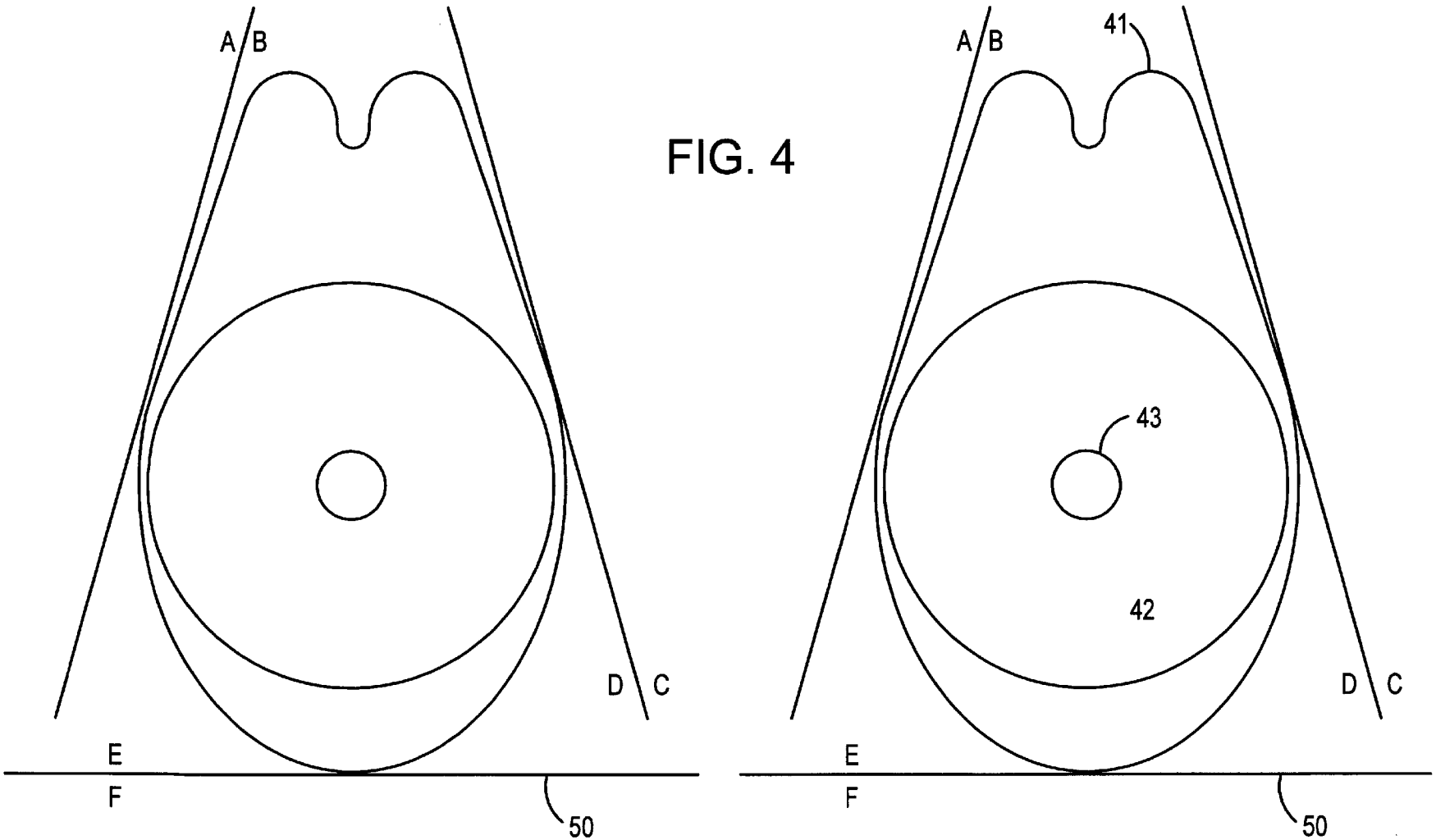
FIG. 4 is a plan view depiction of the rotation mechanism for a display device at 0° rotation.

The rotation of the panels is described referring to four different stages of rotation. As shown in FIG. 4 stage 1, the panels are aligned to present a uniform display surface 50*f* with the two panels that are not displayed being in a triangular position behind the display panel.

Figure 5:
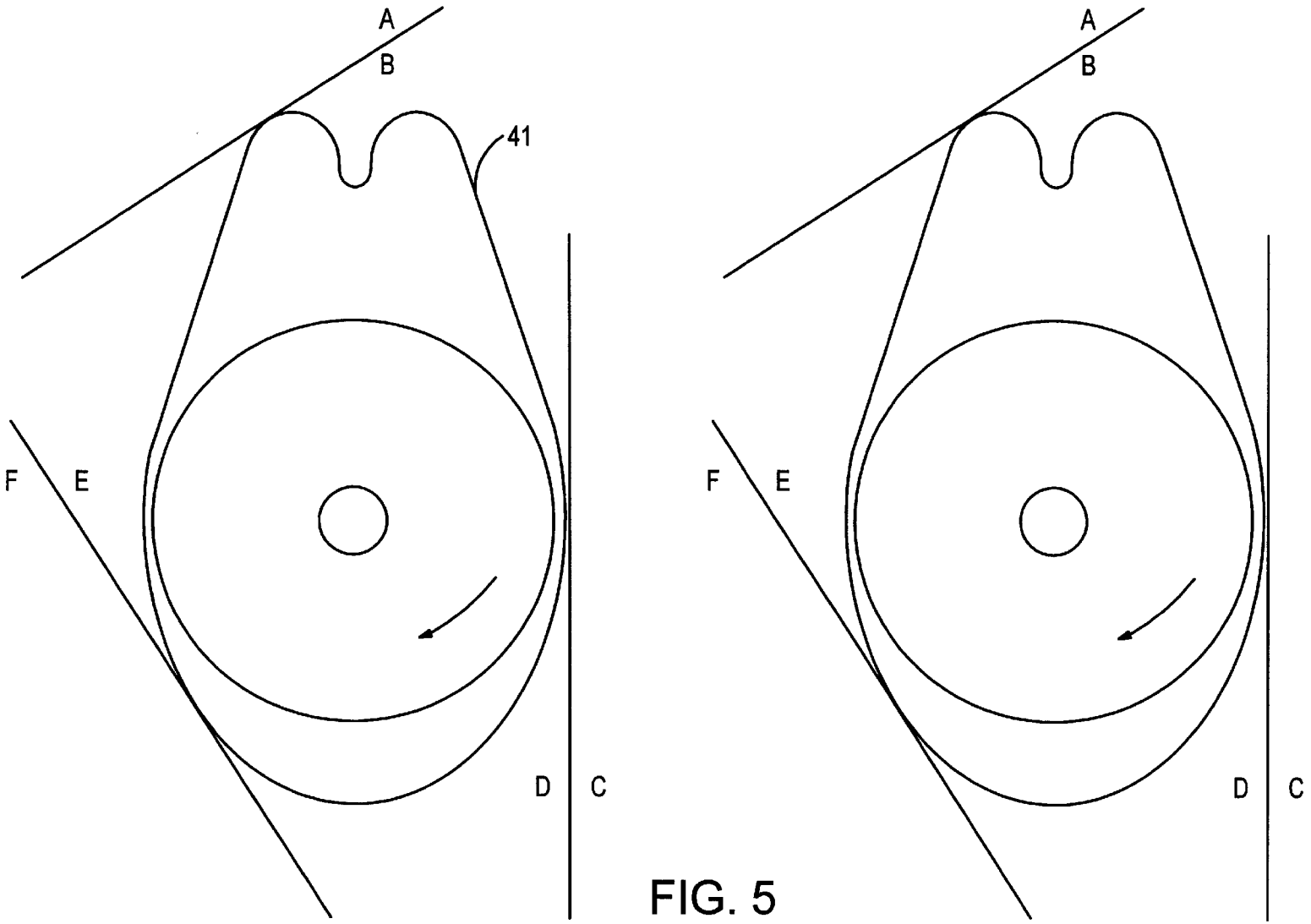
FIG. 5 is a plan view depiction of the rotation mechanism for a display device at 50° rotation.

FIG. 5 stage 2, represents a 50° clockwise rotation. At this point, the "AB" panel is following the eccentrically shaped cam face 41 and beginning to be repelled from the central axis 43. At the same time, the "AB" panel is beginning its angular advance, about its own axis. Panels CD and EF are merely in a clockwise rotational movement and do not pivot.

Figure 6:
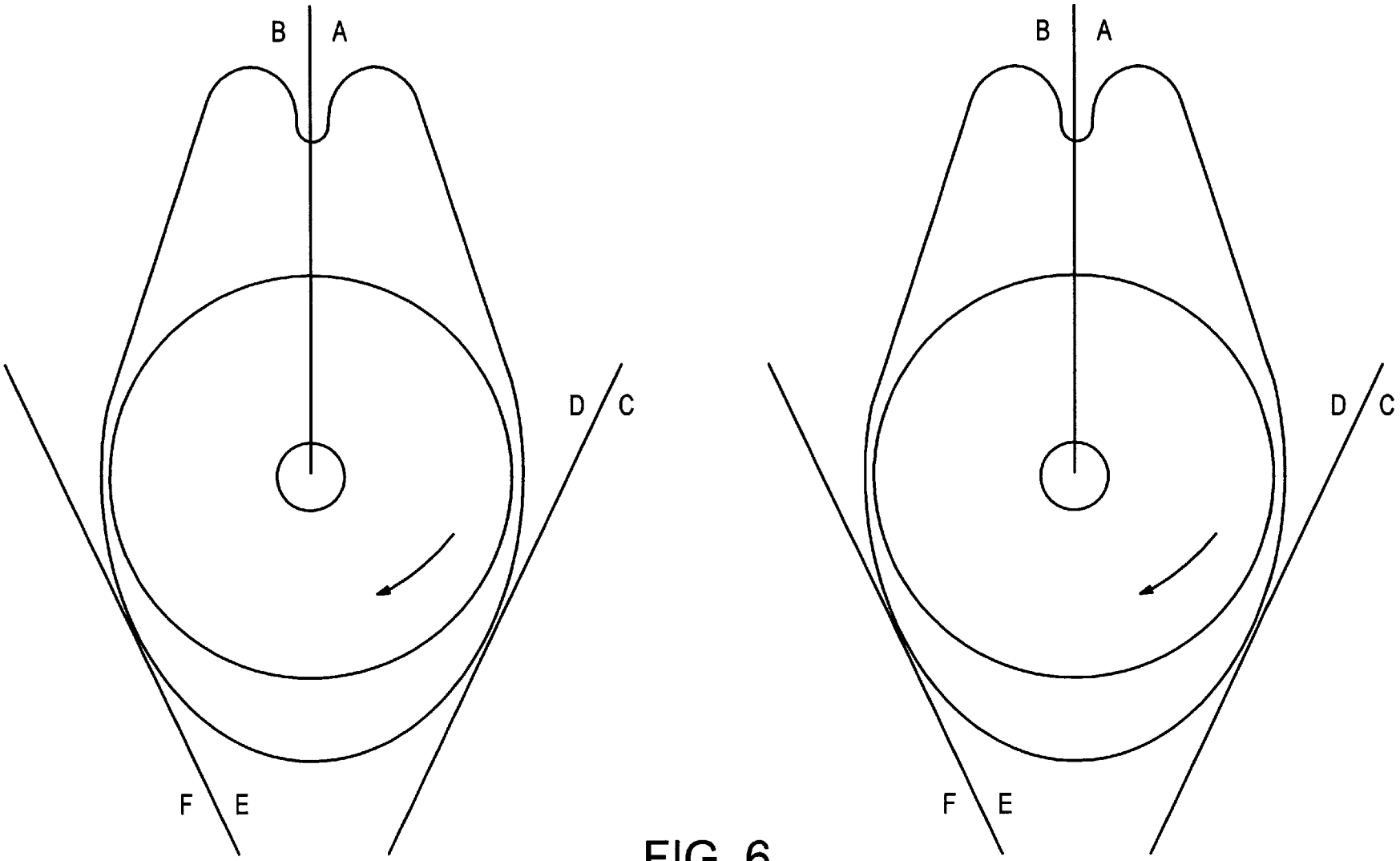
FIG. 6 is a plan view depiction of the rotation mechanism for a display device at the turning node.

FIG. 6 stage 3, represents a clockwise rotation at the turning node. As the carrier continues its rotation into the turning node, the cam follower is drawn towards the central axis by the tension in the spring-loaded slide block 48 and the AB slat continues to rotate around its own axis. Panels CD and EF continue in their rotation.

Figure 7:
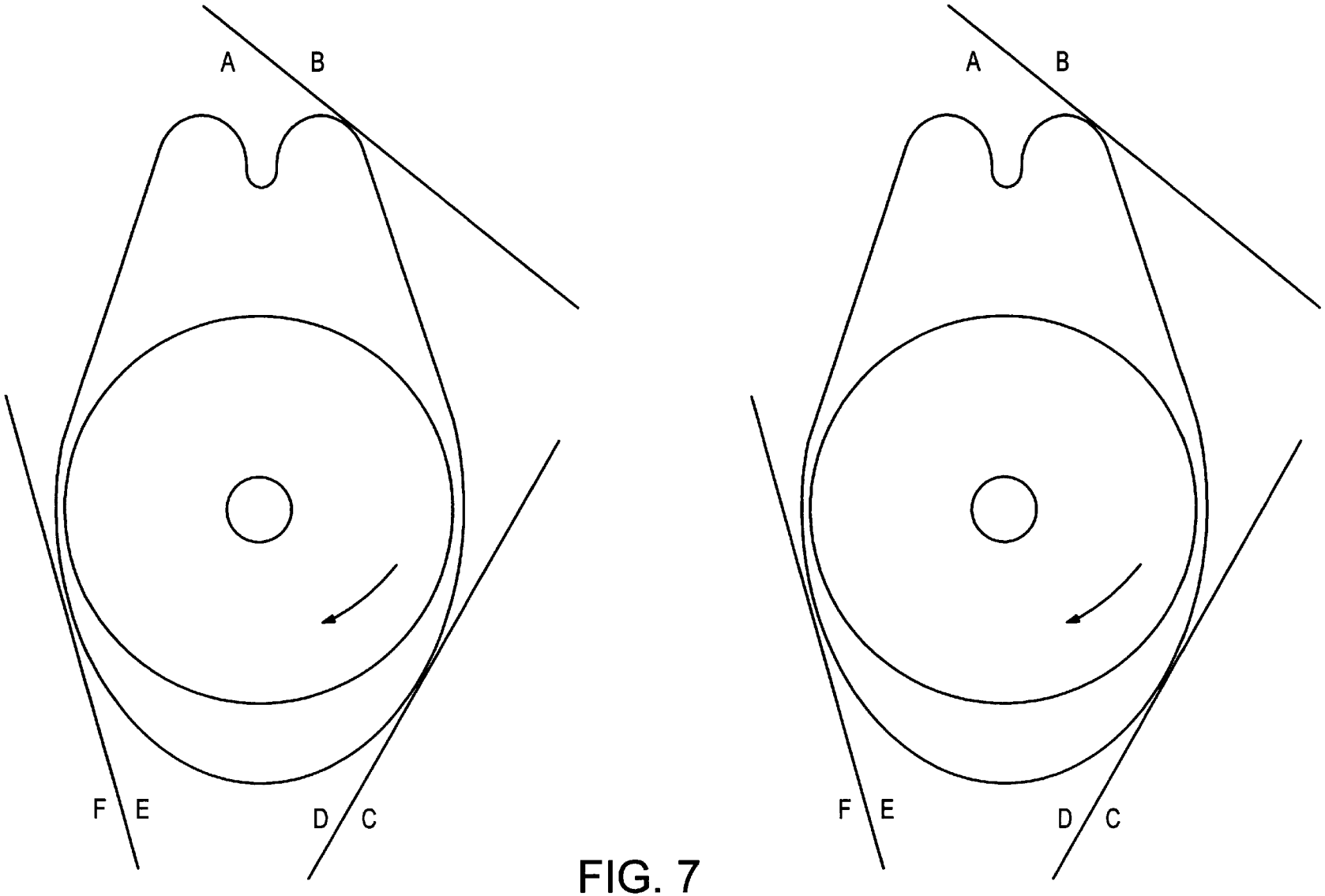
FIG. 7 is a plan view depiction of the rotation mechanism for a display device just past the turning node.

FIG. 7 stage 4, represents a clockwise rotation just past the turning node. At this stage, the carrier continues its rotational movement as panel AB has nearly completed its 180° angular turn and begins to align itself with CD and EF to form its original prismatic configuration. Display surface C comes into viewing position at the completion of the 120° rotation.

This process is repeated five times to reveal all six display surfaces, from what resembles a three-sided prism.

FIG. 9 offers an additional depiction of a panel rotation sequence. This figure shows the motion of one cam follower completing a 180° panel flip. At position 71, as the cam follower turns in the eccentrically shaped cam track, the cam follower is moved outward from the center of rotation of the triangular panel holder configuration to the turn position 76 opposite the line of display. The leading edge of the cam follower B begins to fall into the cam recess at position 72. The cam recess causes the cam follower to tumble over at position 73. The clockwise rotation continues and causes the reversal of the leading and following ends of the cam follower at position 74. The leading roller of the cam follower at position 75 is now A instead of B, and as a result, the display side of the panel has been flipped.

Although the preferred embodiment has been presented, there are other embodiments of this invention that will achieve the same rotational effect. For example, the panel holder and carrier assemblies could be configured differently but still allow a cam follower to direct panel rotation. The carriers could be rotated directly by a gear system instead of a drive shaft and drive belt.

Drive Assembly

Figure 10:
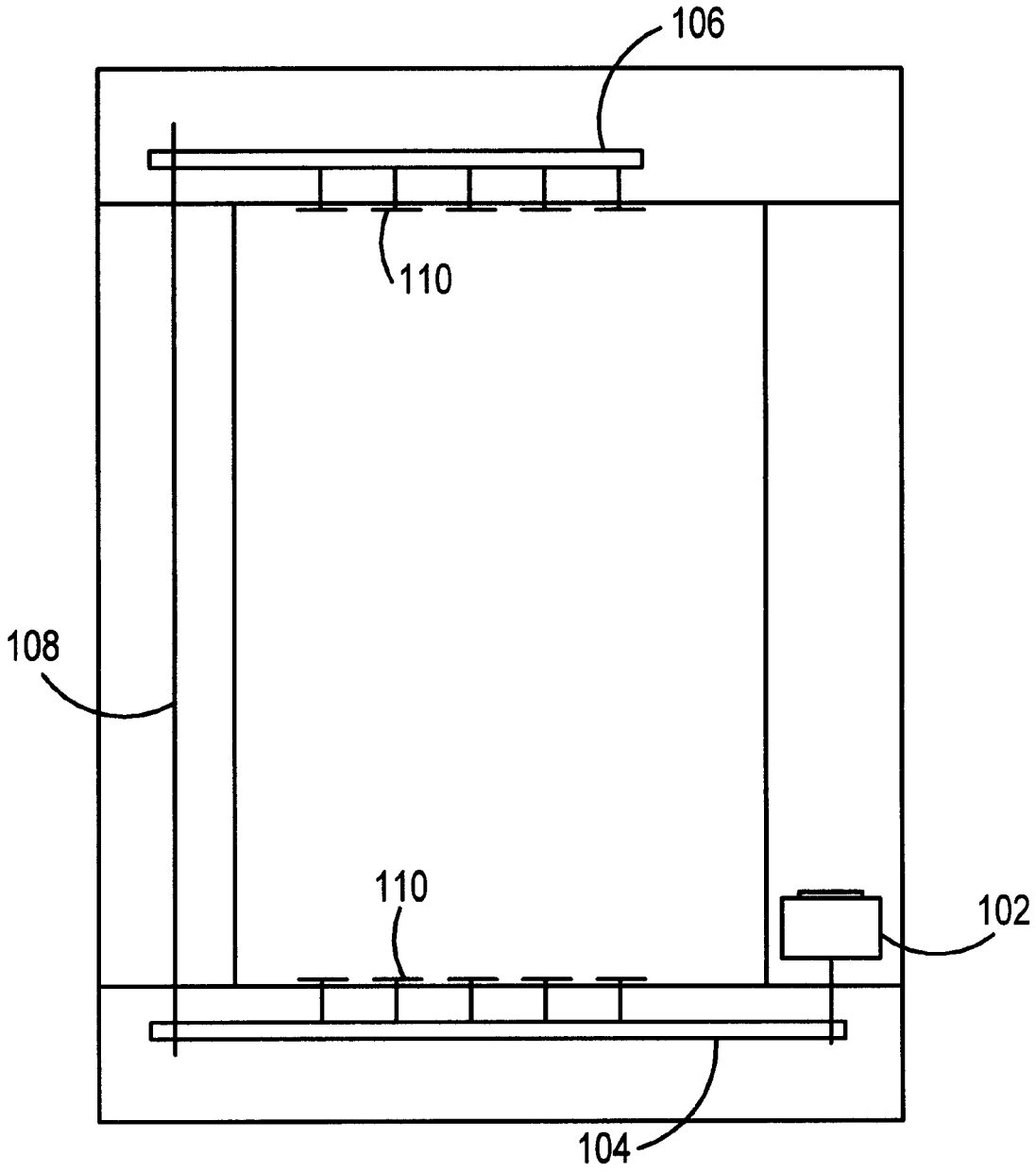
FIG. 10 is a depiction of a drive assembly in a display unit.

FIG. 10 depicts the preferred drive assembly 100. The drive assembly utilizes one motor 102 and a drive shaft 108 to impart the necessary rotary motion. In this arrangement, the motor is located near the bottom of a vertical display device. The motor is coupled to the bottom end panel holders via a timing drive belt 104. The drive belt is also connected to the bottom end of the vertical drive shaft 108. The vertical drive shaft is then connected to a top end drive belt 106. The top end drive belt then imparts the same rotary motion to the top of the panels as the bottom of the panels receive. It is important that the upper and lower drives be indexed or synchronized to maintain the upper and lower portions of the display panels in a single plane to avoid interference as the panels are rotated.

In other embodiments, the vertical drive shaft could be located in a different position, for example, next to the motor. Drive chains could replace the drive belts. Additionally, the vertical drive shaft could be horizontal in a horizontal display system.

Panel Drive Control System

Figure 11:
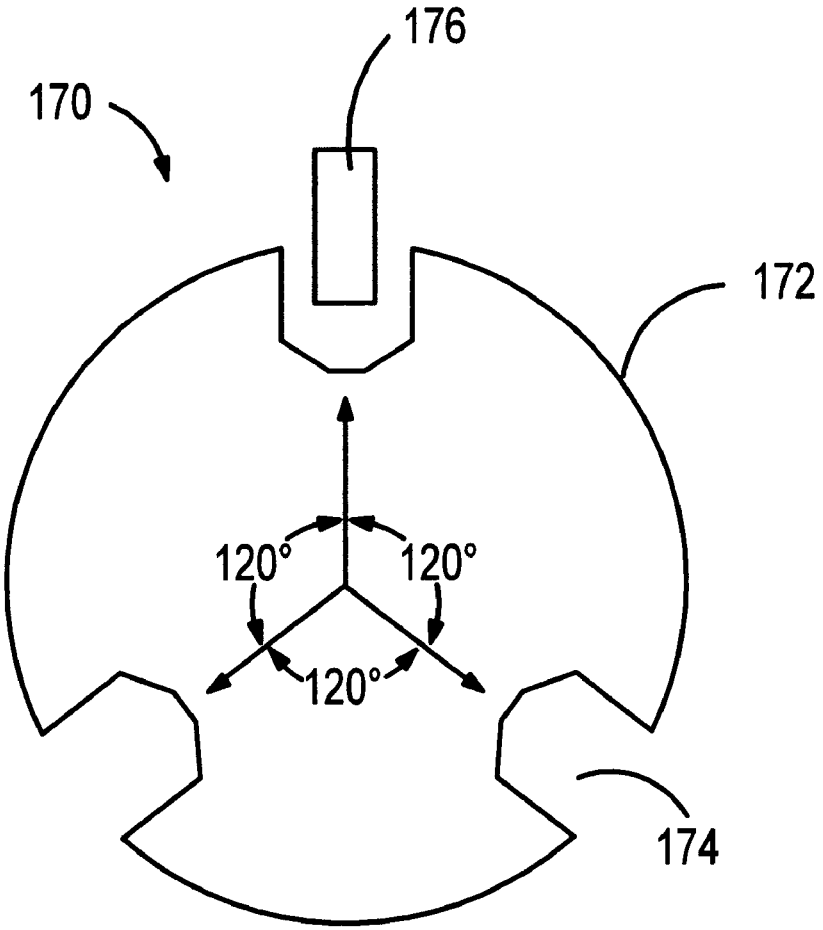
FIG. 11 is a depiction of a drive mechanism control system.

As shown in FIG. 11, the preferred panel drive control system consists of an aluminum disc and photo cell sensor system 170. The aluminum disc 172 has three slots 174 machined into the outer edge of the disc at 120° intervals. The aluminum disc is integrated into the drive mechanism such that the drive mechanism rotation is directly related to the disc rotation. The photo cell sensor 176 is located adjacent to the disc. As the disc rotates, the photo cell sensor is able to detect light whenever one of the three slots passes by the sensor. Once the photo cell sensor detects light, it signals the drive mechanism to stop. The system could be reversed to provide arms to interrupt the light to stop the rotation. This mechanism ensures that the drive mechanism only rotates each of the display elements once per 360° rotation and it also ensures that the display elements will be properly aligned for display in the case of jams or other interruptions.

In other embodiments, the disc can be made of any appropriate material and the disc does not necessarily have to have only three slots at 120° increments for various features. The slots could be, for example, every 60° or every 30°. But, a signal at 120° intervals is needed for panel rotation. As well, the slots could be any beacon on the disc which could be detected by a sensor. The sensor does not necessarily have to be a photocell sensor. The beacon/sensor system could be a spring electric contact, for example. The sensor system could also be located in different places, such as attached to a display panel and the disk is not required to be disk-shaped.

Cam Assembly

Figure 12:
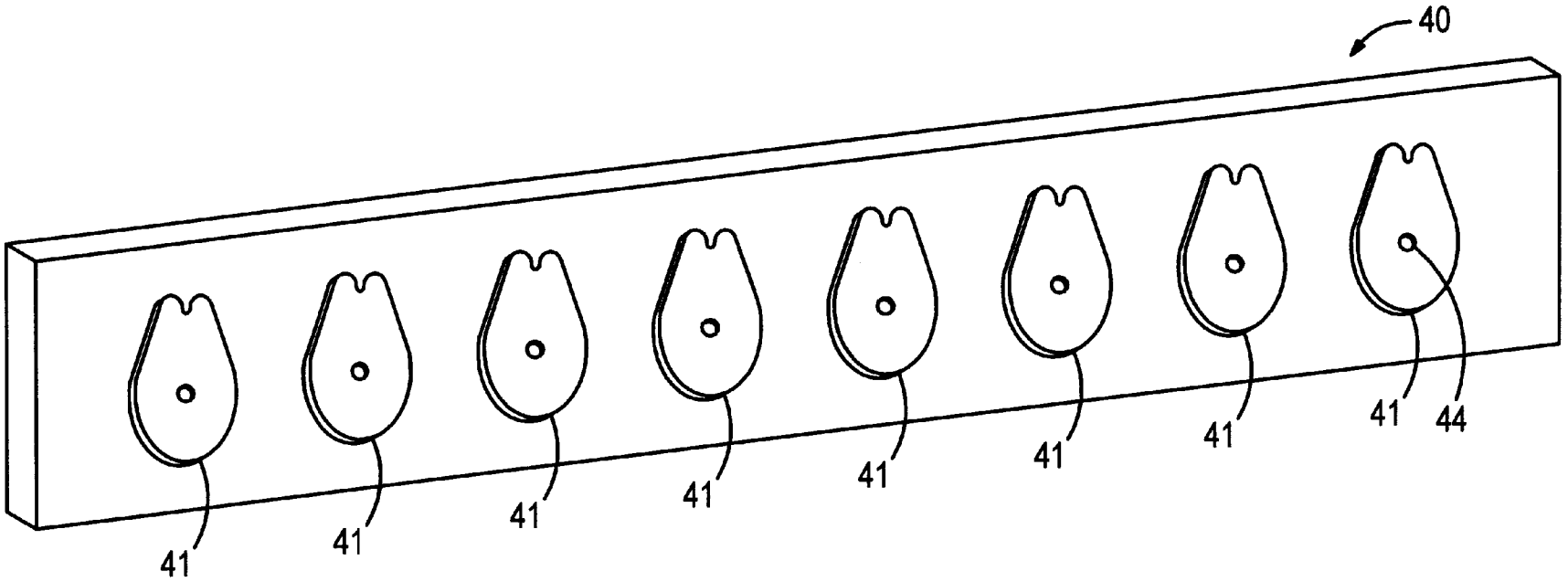
FIG. 12 is a depiction of a cam block with eight cams.

FIG. 12 depicts the preferred cam plate 40. The body of the cam in the preferred assembly consists of a rectangular solid aluminum plate. The plate has a series of raised cams with the raised surface that is perpendicular to the cam plate being the cam face 41. Through holes 44 are located at the center of each cam. The cams are utilized to guide the cam riders through the proper rotation. The through hole in each cam is provided so that the carrier shaft that is attached to the panel holder can protrude through the cam assembly and be connected to the drive mechanism.

In other embodiments, the cam assembly may be made of some other metal or a polymer.

What is claimed is:

1. A control system for controlling operations of a panel drive comprising:

a panel assembly, said panel assembly having a plurality of panels which are arranged in side-by-side fashion such that scenes are displayed to a viewer and such that said scenes can be changed through rotation of said panels;

a rotary member mounted to rotate when said panel assembly rotates, said rotary member having a plurality of indicators at known intervals, said plurality of indicators including slots formed on said rotary member; and detector means for generating an output signal responsive to detection of said indicators, said detector means being configured to monitor rotations of said rotary member so as to ensure that said rotary member stops and starts at precise locations.

2. The control system of claim 1 wherein said rotary member is disk-shaped.

3. The control system of claim 1 wherein said rotary member is directly mounted onto one of said plurality of panels.

4. The control system of claim 1 wherein said plurality of indicators includes electrical contact points attached to said rotary member at known locations.

5. The control system of claim 1 wherein said detector means is a photo detector oriented with respect to said rotary member such that said photo detector detects light passing through said slots.

6. The control system of claim 5 wherein three of said slots are formed in said rotary member, with each slot being separated by 120°.

7. The control system of claim 6 wherein said three slots correspond to three said panels of said panel assembly.

8. The control system of claim 7 wherein said rotary member is mounted to rotate in direct correspondence with rotation of said panel assembly.

9. A drive control system for a multi-panel display comprising:

a display assembly;

a plurality of columns, connected to said display assembly, each column having at least three panels and at least three rest positions, said three panels arranged for rotation about a column axis such that in any one of said rest positions one of said panels is in a display position and two of said panels are in a triangular position behind said panel in said display position;

means, connected to said display assembly, for rotating said columns about said column axis;

a rotary member, mounted to rotate in correspondence with said plurality of columns, said rotary member having a plurality of indicators at known intervals around said rotary member wherein at least one of said indicators relates to one of said rest positions, said rotary member including a disk-shaped region on which said indicators are formed, said indicators being slots within said disk-shaped region; and means, associated with said rotary member, for optically determining when one of said slots is located in a known position with respect to rotation of said plurality of panels about said column axis.

10. The drive control system of claim 9 wherein said slots of said rotary member are features of said rotary member which cause a change in light transmission based upon the rotational position of said rotary member.

11. The drive control system of claim 10 wherein said means for determining includes a photo detector mounted relative to said rotary member such that said photo detector can detect said change in light transmission caused by said slots.

12. The drive control system of claim 11 wherein said slots are at least three void spaces formed by said rotary member that are separated by 120°, wherein said three slots are located in positions such that said change in light transmission occurs at said rest positions.

13. The drive control system of claim 9 wherein said rotary member includes three of said slots so as to correspond on a one-to-one basis with said rest positions of said columns such that detection of one of said slots in said known position ensures that one of said panels is in said display position.

14. A display device comprising:

a panel display column having three two-sided panels and having three rest positions corresponding to the number of two-sided panels, said three two-sided panels arranged about a column axis, said three two-sided panels arranged for rotation about said column axis such that in any one of said rest positions one of said panels is in a display position and two of said panels are in a triangular position behind said panel in said display position, each two-sided panel having different scenes on opposite sides;

means for rotating said column about said column axis and for flipping a selected one of said two-sided panels about a panel axis that is parallel to said column axis;

a rotary member mounted to rotate in correspondence with rotation of said panel display column, said rotary member having a rotational axis, said rotary member having a plurality of slots at known intervals of angular displacement about said rotational axis; and detector means for generating an output signal responsive to detection of said slots, said detector means being electrically connected to said means for rotating to ensure that said panel display column starts and stops at precise locations.

15. The display device of claim 14 wherein said slots of said rotary members are features of said rotary member which cause a change in light transmission based upon the rotational position of said rotary member, and wherein said detector means includes a photo detector mounted relative to said rotary member such that said photo detector can detect said changes in light transmission caused by said slots.

16. The display device of claim 14 wherein said means for rotating said panel display column includes a carrier shaft and drive gear assembly comprising:

a radially expandable carrier shaft, said shaft having a first end attached to manipulate said panel display column and having a second end, said carrier shaft having a relaxed state in which an expandable portion of said carrier shaft has a first diameter and having an expanded state in which said expandable portion of said carrier shaft has a second diameter;

a drive gear attached to said second end of said carrier shaft, said drive gear having a through hole that fits over said expandable portion of said carrier shaft, said through hole having a third diameter slightly larger than said first diameter and smaller than said second diameter, said drive gear being configured for attachment to a drive mechanism; and a removable shaft expansion member inserted into said second end of said carrier shaft such that said expandable portion of said carrier shaft expands to said second diameter when said member is inserted.

17. The display device of claim 14 wherein said means for rotating said panel display column includes at least one cam assembly, each said cam assembly comprising:

a cam having a cam face and a drive shaft located through the center of said cam;

a carrier having a plurality of radial slots, said carrier attached at its center to said drive shaft;

a slide mechanism in each of said radial slots supporting a cam follower and one of said two-sided panels at an outer end of said slide mechanism; and spring means for holding said cam follower on said cam face.

18. A panel holder for use in an array of said panel holders in a side-by-side arrangement to display multiple scenes comprising:

a first base plate having first fingers;

a second base plate having second fingers;

a plurality of panels having first and second arrays of holes at opposite ends, each said panel having a portion of a scene on each face of said panel, said first and second base plates being at opposite ends of said panel, said first fingers of said first base plate extending into said holes of said first array and said second fingers of said second base plate extending into said holes of said second array, said fingers thereby securing said panel in position;

spring means for biasing at least one of said first and second base plates in a direction to tension said panels, thereby promoting alignment of said panels: and means for attaching said first and second base plates to a device for holding an array of said panels.

19. A display device comprising:

a panel display column having three two-sided panels and having three rest positions corresponding to the number of two-sided panels, said three two-sided panels arranged about a column axis, when said column is in any one of said rest positions such that one of said panels is in a display position and two of said panels are in a triangular position behind said panel in said display position, each two-sided panel having different scenes on opposite sides; and means for rotating said column about said column axis and for flipping a selected one of said two-sided panels about a panel axis that is parallel to said column axis while said panel axis of said selected one panel is caused to rotate eccentrically about said column axis, said eccentric rotation shifting said panel axis of said selected one panel further from said column axis to allow flipping of said selected one panel in an absence of obstruction by adjacent said two-sided panels.

* * * * *